US005458143A

United States Patent [19]

Herr

[11] Patent Number: 5,458,143

[45] Date of Patent: Oct. 17, 1995

[54] CRUTCH WITH ELBOW AND SHANK SPRINGS

[76] Inventor: Hugh M. Herr, 20 Daniels St., Apt. 222, Malden, Mass. 02148

[21] Appl. No.: 257,285

[22] Filed: Jun. 9, 1994

[51] Int. Cl.[6] ..... A61H 3/02

[52] U.S. Cl. ..... 135/68; 135/71

[58] Field of Search ..... 135/65, 66, 68, 135/71, 72, 73, 76

[56] References Cited

U.S. PATENT DOCUMENTS

| | | | |
|---|---|---|---|
| 1,244,249 | 10/1917 | Schlick | 135/71 |
| 1,547,046 | 7/1925 | King | 135/71 |
| 3,213,869 | 10/1965 | Frank | 135/71 |
| 4,869,280 | 9/1989 | Ewing | 135/71 X |
| 5,331,989 | 7/1994 | Stephens | 135/71 X |

*Primary Examiner*—Lanna Mai

[57] ABSTRACT

A crutch system comprising an elbow spring and a shank spring stores and releases energy during crutch locomotion. The elbow spring compresses during elbow flexion and then expands, extending the elbow and lifting the body upwards during uphill crutch locomotion. The shank spring compresses during impact of the crutch bottom with the ground and then expands, thrusting the user upwards and forwards.

The crutch of this invention maximizes stability, cushioning, and efficiency.

7 Claims, 6 Drawing Sheets

CRUTCH WITH ELBOW AND SHANK SPRINGS

TECHNICAL FIELD

The invention relates to a crutch for use by physically disabled persons. The crutch includes an elbow spring and a shank spring that permit maximum locomotion efficiency for maneuvering over flat surfaces, up and down steps, and up and down hills.

BACKGROUND OF THE INVENTION

Currently two crutch designs have met with commercial success: the underarm crutch and the forearm crutch. The underarm crutch is more stable than the forearm crutch but does not allow elbow flexion. The crutch extends above the elbow to a padded underarm rest. When the user grips the hand rest near the middle of the crutch and flexes his elbow, the underarm rest seats underneath his arm, impeding full elbow flexion. This makes going up and down hills and steps very difficult. On the other hand, the forearm crutch allows flexion at the elbow but is less stable than the underarm crutch, increasing the metabolic energy requirements of locomotion. Since the crutch does not extend above the elbow, the user cannot stabilize the crutch against his body as well as with the underarm crutch. In addition to these deficiencies, neither crutch design employs springs to maximize locomotion efficiency for all types of terrain. These problems are overcome by the present invention.

SUMMARY OF THE INVENTION

This invention comprises a crutch system for attachment to an arm comprising elastic springs for absorbing the energy of impact of said crutch with a surface and releasing said energy to propel the user upwards and forwards. In addition, the crutch of this invention comprises springs for storing energy when the elbow flexes and releasing said energy to assist elbow extension, enabling the user to use both elbow muscle flexors and extensors to ascend stairways and hills.

This invention demonstrates how efficient springs can be used in a crutch to maximize crutch cushioning, stability, and efficiency. The term "spring" as used in this document is defined as follows. When forces compress, bend, or stretch a body, the body is said to be a "spring" if it returns to its original shape after the forces are released. The body is considered an "efficient spring" if 70% or more of the work done to deform the body can be performed by the body itself as it returns to its original shape.

An energy return of 90% or higher is preferred for the springs of this invention. To attain this, the present invention provides a spring configuration made of suitable energy-absorbing materials known to the art having non-plastic properties.

One embodiment of this crutch invention comprises an elbow spring formed by at least one spring element coupling, directly or indirectly, the upper arm engaging portion of said crutch to the forearm/hand engaging portion, enabling said portions to move toward one another. The elbow spring elements have to be efficient and light weight.

The word "coupling" as used in this document means joining or linking two parts together directly or indirectly. Spring element or elements coupling a portion "A" to a portion "B" directly would span the entire distance between said portions. Spring element or elements coupling a portion "A" to a portion "B" indirectly would not extend the entire distance between said portions. For example, a rigid link or rigid links could connect a portion "A" to a spring element or spring elements, and said spring element(s), in turn, could join said rigid link(s) with a portion "B".

To use the crutch of this invention to ascend steps or hills, the user flexes his elbows moving his hands towards his shoulders to compress the elbow spring elements. This stored energy in turn helps the muscle extensors straighten the elbows and to lift the body upward. Without the elbow spring elements, most of the work to ascend a hill or stairway is carried out by the muscles which extend the arm, and because of this fact, many times the arm extensors fatigue, forcing the user to stop in order to rest. With the elbow spring elements in the crutch, the work to ascend a hill or stairway is carried out by both the elbow extensors and flexors. The work to ascend a hill is performed using additional arm muscles, increasing the endurance of the crutch user considerably.

Another embodiment of this invention consists of a crutch system comprising a shank spring. The shank spring is formed by at least two spring elements coupling, directly or indirectly, the forearm/hand engaging portion of said crutch to the ground engaging portion, enabling said portions to move relative to one another. The shank spring elements have to be efficient and light weight.

During flat, over ground locomotion with the crutch of this invention, the shank springs begin to compress when the crutches strike the ground, reducing impact forces to the hands and to the shoulders. This stored energy in turn propels the crutch user upwards and forwards, minimizing the metabolic energy requirements of crutch locomotion.

A preferred embodiment of this invention consists of a crutch system comprising an elbow spring and a shank spring. As described earlier, the elbow spring is formed by at least one spring element coupling, directly or indirectly, the upper arm engaging portion of said crutch to the forearm/hand engaging portion, enabling said portions to move toward one another. The shank spring is formed by at least two spring elements coupling, directly or indirectly, the forearm/hand engaging portion of said crutch to the ground engaging portion, enabling said portions to move relative to one another. The elbow and shank spring elements have to be efficient and light weight.

The exact nature of this invention as well as other objects and advantages thereof will be readily apparent from consideration of the following specification relating to the drawings.

DETAILED DESCRIPTION OF THE PREFERRED EMBODIMENTS

The following principles govern the improved crutch system of this invention:

1. The crutch should include an upper arm engaging portion so that crutch stability is maximized, i.e., the crutch should extend above the elbow.

2. The crutch design should allow for elbow flexion, i.e., the user should be able to move the forearm/hand engaging portion of the crutch towards the upper arm engaging portion.

3. A spring or springs should compress or bend when the forearm/hand engaging portion moves towards the upper arm engaging portion during elbow flexion. The elbow spring of this invention satisfies this requirement.

4. The elbow spring of principle 3 should have that stiffness where the elbow muscle extensors and flexors fatigue simultaneously during uphill crutch locomotion.

5. The crutch should store energy upon impact of the crutch bottom with the ground in a spring positioned between the forearm/hand engaging portion of the crutch and the ground engaging portion. Furthermore, the spring should be a soft spring, i.e., the spring stiffness should decrease with increasing spring deflection. In addition, the spring should not be a spring-loaded piston with one member sliding inside another. A spring of this type would either be inefficient because of frictional losses between the sliding members or would be unnecessarily expensive and heavy because a lubrication system would have to be employed to minimize frictional losses. The shank spring of this invention satisfies these requirements.

6. The shank spring of principle 5 should include a mechanism by which its stiffness can be adjusted for different terrain and locomotion speeds.

7. The elbow and shank springs of principles 3 and 5, respectively, should be efficient and lightweight. To produce efficient and lightweight springs, a resin-impregnated, high-strength filament material should be used.

The first embodiment of this invention comprises an elbow spring formed by at least one spring element coupling, directly or indirectly, the forearm/hand engaging portion to the upper arm engaging portion of a crutch, enabling said portions to move relative to one another. The elbow spring exerts a torque about the elbow joint axis, tending to straighten or extend the elbow from a flexed position. Thus, the elbow spring should be in equilibrium when the user's elbow is nearly straight or fully extended.

Figure 1:
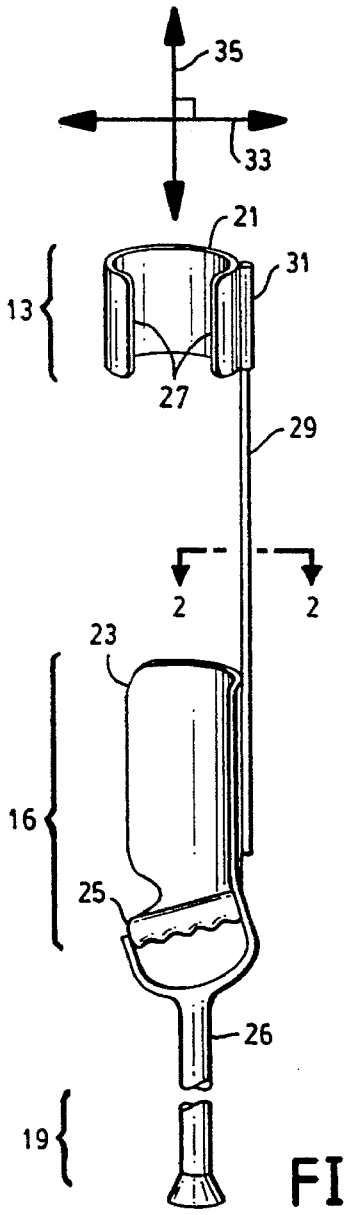
FIG. 1 shows the lateral view of a left hand crutch having a single leaf spring element as an elbow spring.

FIG. 1 shows the lateral view of a left hand crutch having an upper arm engaging portion 13, a forearm/hand engaging portion 16, and a ground engaging portion 19. The upper arm engaging portion 13 is formed by upper arm cuff 21, and the forearm/hand engaging portion 16 is formed by forearm rest 23 and hand seat 25. Y-bracket 26 couples the forearm/hand engaging portion 16 to the ground engaging portion 19. The lateral side of upper arm cuff 21 has an opening 27 to allow for easy insertion of the user's upper arm into said cuff. An elbow spring formed from a single leaf spring 29 seats into housing 31 on the posterior side of upper arm cuff 21. The top portion of leaf spring 29 is not rigidly attached to upper arm cuff 21 but can piston relative to cuff 21 inside housing 31. The lower end of leaf spring 29 is clamped or fastened to the posterior side of forearm rest 23. The distance between upper arm cuff 21 and hand grip 25 can be adjusted for different arm lengths by changing the amount of leaf spring 29 and forearm rest 23 overlap and then re-clamping. Leaf spring 29 and forearm rest 23 should be attached in a manner which allows for easy adjustability. This can be accomplished in a number of ways known to the art. A simple means of attachment would be to use two bolts and two wing nuts.

It is noted at this point that throughout the drawings left hand crutches are sketched. The invention, of course, is equally applicable to right hand crutches.

In FIG. 1, axis 33 is in the fore-and-aft or longitudinal direction, and axis 35 is in the vertical direction. When the arm is attached to the crutch and when the crutch is aligned vertically, the arm is in the vertical fore-and-aft plane, the plane defined by axes 33 and 35.

Figure 2:
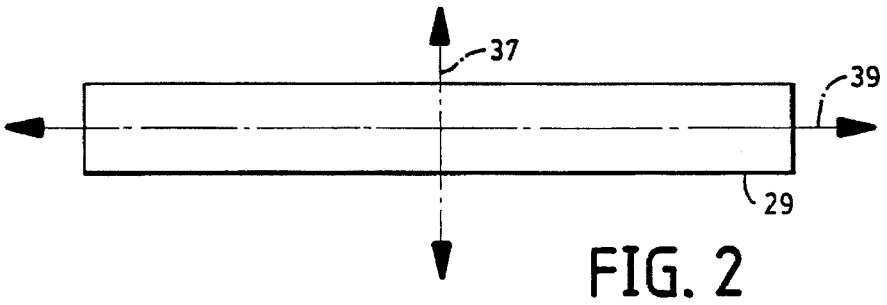
FIG. 2 shows a sectional view taken on line 2—2 of FIG. 1 looking in the direction of the arrows.

FIG. 2 shows a sectional view taken on line 2—2 of FIG. 1 looking in the direction of the arrows. Axis 37 is generally aligned in the fore-and-aft direction, and horizontal or transverse axis 39 is generally aligned perpendicular to the fore-and-aft direction. Leaf spring 29 has a horizontal cross section with a relatively high area moment of inertia about axis 37 and a relatively low area moment of inertia of the same cross section about axis 39. This type of cross section provides a very rigid structure about axis 37, but substantial energy-absorbing compliance about axis 39. Thus, leaf spring 29 can be flexed in the vertical fore-and-aft plane, but is very difficult to bend in the vertical transverse plane, or the plane defined by axes 39 and 35. Furthermore, if leaf spring 29 is made from a resin-impregnated, high-strength filament, the torsional stiffness of said spring about vertical axis 35 can be maximized by having a preponderance of fiber layers with fibers running off vertical in the vertical transverse plane, preferably plus and minus 45 degrees off vertical. These design features make the crutch more rigid and stable while still enabling the user to bend at the elbow in the vertical fore-and-aft plane.

Figure 3:
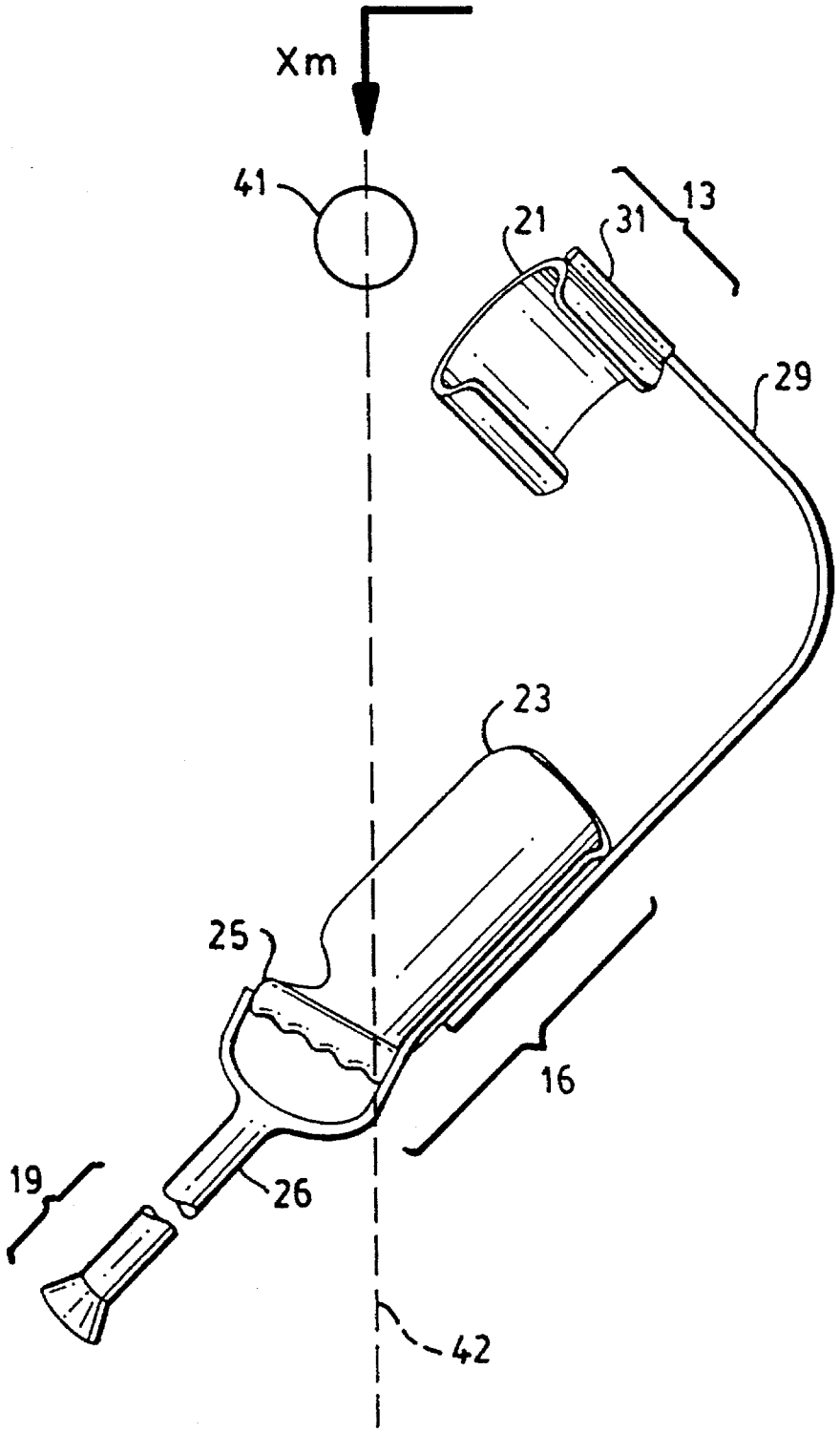
FIG. 3 shows the crutch of FIG. 1 with the elbow spring compressed.

FIG. 3 shows the crutch of FIG. 1 with the elbow spring compressed a vertical distance Xm. With the arm seated in the crutch, the stiffness of the elbow spring for bending in the vertical fore-and-aft plane is defined as the vertical force required to compress the spring a vertical distance Xm acting through the approximate shoulder axis 41 divided by Xm. When spring 29 is compressed in this manner, hand seat 25 moves vertically towards shoulder axis 41 along axis 42.

The optimal stiffness is that which causes the elbow muscle extensors and flexors to fatigue simultaneously during uphill crutch locomotion. This spring stiffness will maximize the crutch user's endurance for ascending hills and stairways. To derive this optimal stiffness, we must first define the energy or work partition ratio, or $$\Psi = \frac{Wf}{We} \tag{1}$$

Wf is the optimal amount of positive work the elbow muscle flexors should do while ascending a given hill or stairway, and We is the optimal amount of positive work the elbow muscle extensors should do while ascending the same hill or stairway so that both the flexors and extensors fatigue simultaneously or at the same rate. With the work partition ratio defined, we can now derive the optimal elbow spring stiffness.

The work done by the elbow muscle flexors of one arm to climb a hill or stairway is equal to the energy stored in the spring when the arm is fully flexed multiplied by the total number of steps taken throughout the climb, assuming the position of the subject's whole body center of mass changes negligibly during elbow flexion. Assuming elbow spring linearity, we have $$Wf = n^*\left(\frac{1}{2}K(Xm)^2\right) \tag{2}$$

where K is the elbow spring stiffness, Xm is the maximum vertical compression of the spring discussed earlier, and n is the total number of steps taken during the climb. For normal crutch use, Xm is approximately equal to the height of a single stairway step.

Now, the elbow extensor work of one arm to climb a hill or stairway is $$We = n^*\left(\frac{M}{2}gXm - \frac{1}{2}K(Xm)^2\right) \tag{3}$$

where g is the gravitational constant and M is the mass of the crutch user.

Combining equations 1, 2, and 3, yields $$\Psi = \frac{KXm}{Mg - KXm} \tag{4}$$

Now equation 4 can be solved for the dimensionless elbow spring stiffness, or $$\frac{K^*Xm}{M^*g} = \frac{\Psi}{(1+\Psi)} \tag{5}$$

Figure 4:
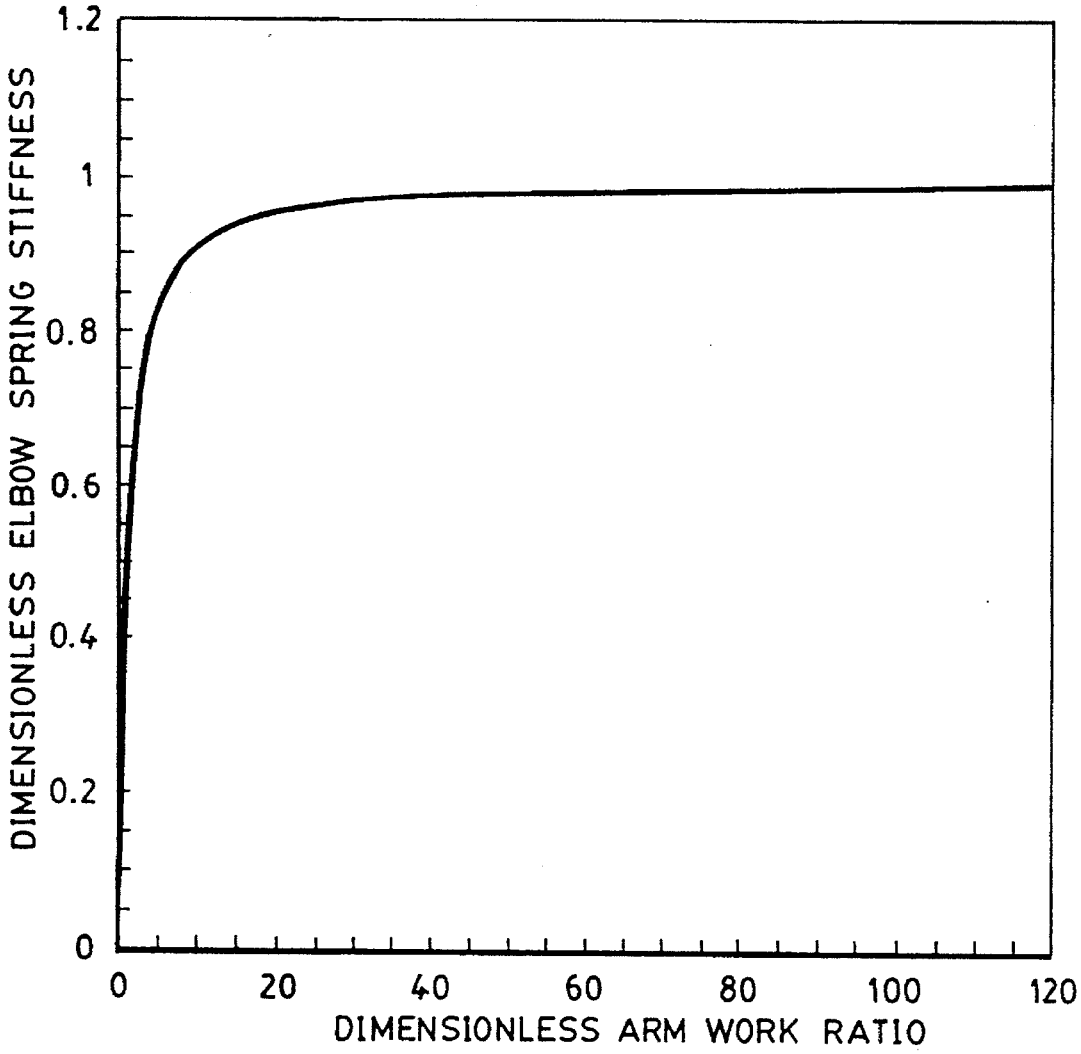
FIG. 4 shows the dimensionless elbow spring stiffness versus the dimensionless arm work ratio.

In FIG. 4, the dimensionless stiffness KXm/Mg versus the work partition ratio Ψ is plotted. Note that as the work ratio goes to infinity, the dimensionless stiffness approaches one, and all the arm work is done by the elbow flexors. This would be the case if a crutch user had a severe muscle injury in an extensor muscle and could not push-up any weight. To ascend a hill or stairway with such an injury the flexors would do all the work to raise the center of mass up a hill. When the dimensionless stiffness is greater than one, the energy stored in the left and fight hand crutch elbow springs is greater than the energy required to lift the user's whole body center of mass up a vertical distance Xm. This would simply be a waste of metabolic energy. Thus, the dimensionless elbow spring stiffness should be less than or equal to one as described in FIG. 4.

What is the numerical range of the work partition ratio for normal healthy people? An experimental study was conducted to determine the work partition ratio for six healthy adults. The work ratio value for each subject fell between one and four. Using equation 5, the corresponding dimensionless elbow spring stiffness range is between ½ and ⅘.

Although an elbow spring formed from a single leaf spring element as shown in FIG. 1 and 3 is the preferred type, additional leaf springs or different spring types could be used to form the elbow spring.

Figure 5:
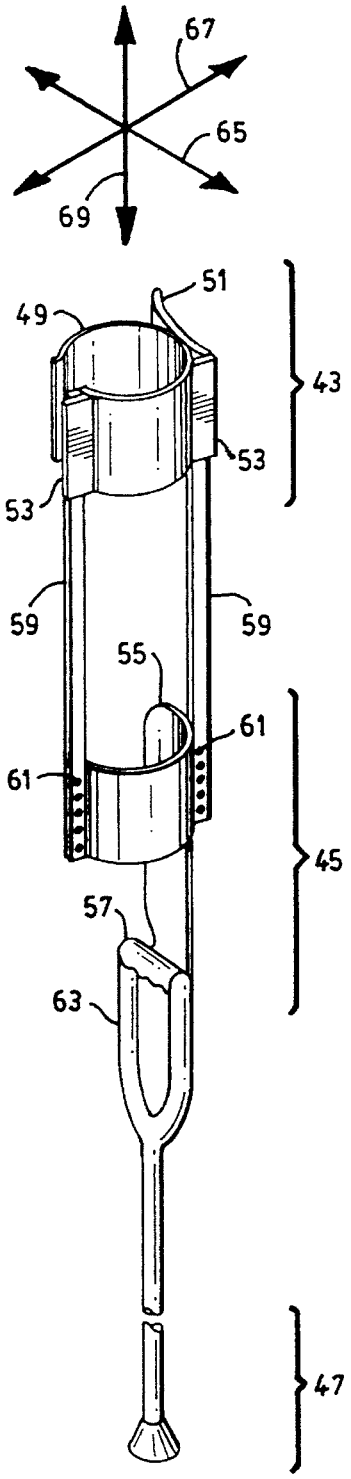
FIG. 5 shows a perspective view of a left hand crutch with two leaf spring elements forming the elbow spring.

FIG. 5 shows a perspective view of a left hand crutch having two leaf spring elements forming the elbow spring. The crutch has an upper arm engaging portion 43, a forearm/hand engaging portion 45, and a ground engaging portion 47. The upper arm engaging portion 43 comprises upper arm cuff 49, underarm seat 51, and housings 53. The forearm/hand engaging portion 45 comprises forearm rest 55 and hand seat 57. The forearm/hand engaging portion 45 is coupled to ground engaging portion 47 by Y-bracket 63. Each leaf spring 59 seats into its respective housing 53, enabling said springs to move relative to upper arm portion 43. Each leaf spring 59 is attached to the posterior side of forearm rest 55 by bolting or clamping through holes 61. The numerous holes 61 enable the crutch user to change the distance between the upper arm engaging portion 43 and the forearm/hand engaging portion 45 to adjust for different arm lengths.

The elbow spring of FIG. 5 has the same numerical dimensionless stiffness ranges defined earlier, i.e., a dimensionless stiffness less than or equal to one or more typically between ½ and ⅘. Thus, single leaf spring 29 of FIG. 1 should be twice as stiff as each leaf spring 59 of FIG. 5 so that both crutches have the same overall elbow stiffness. Similar to leaf spring 29 of FIG. 1, the horizontal cross sectional area of each leaf spring 59 has a relatively high area moment of inertia about an axis generally aligned with the fore-and-aft axis 65 and a relatively low area moment of inertia about a horizontal axis 67 generally aligned perpendicular to the fore-and-aft axis. Furthermore, if leaf springs 59 are made from a resin-impregnated, high-strength filament, the torsional stiffness of said springs about an axis generally aligned with vertical axis 69 can be maximized by having a preponderance of fiber layers with fibers running off vertical in the vertical transverse plane defined by axes 67 and 69, preferably plus and minus 45 degrees off vertical. With these design features, the crutch of FIG. 5 will be rigid for bending in the vertical transverse plane and for twisting about an axis generally aligned with vertical axis 69. Furthermore, the crutch will bend in the vertical fore-and-aft plane with a stiffness that will cause the elbow muscle extensors and flexors to fatigue at the same rate during uphill crutch locomotion.

Figure 6:
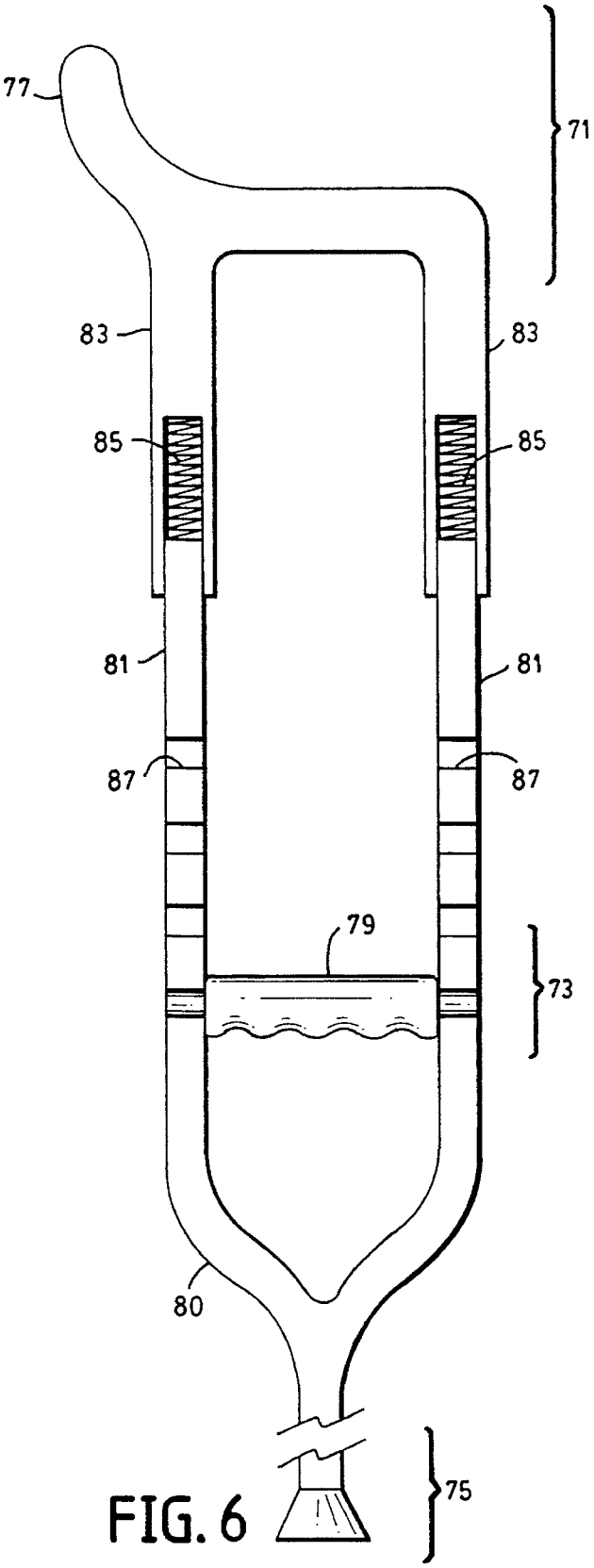
FIG. 6 shows the lateral cross sectional view of a left hand crutch with two coil spring elements forming the elbow spring.

FIG. 6 shows the lateral cross sectional view of a left hand crutch with two coil spring elements forming the elbow spring. The crutch has an upper arm engaging portion 71, a forearm/hand engaging portion 73, and a ground engaging portion 75. The upper arm engaging portion 71 is formed by underarm seat 77, and the forearm/hand engaging portion 73 is formed by hand seat 79. Y-bracket 80 couples hand seat 79 to ground engaging portion 75. Lower links 81 piston inside upper links 83. Coil springs 85 seat inside the piston cavities formed by upper links 83 and lower links 81. The distance between underarm seat 77 and hand seat 79 can be adjusted for different arm lengths by re-bolting hand seat 79 to lower links 81 through a different set of holes 87.

The elbow spring of FIG. 6 has the same numerical dimensionless stiffness ranges defined earlier, i.e., a dimensionless stiffness less than or equal to one or more typically between ½ and ⅘. The stiffness of the elbow spring formed by coil springs 85 in FIG. 6 is defined as the force required to compress both coil springs together a distance Xm divided by Xm.

A second embodiment of this invention consists of a crutch system comprising a shank spring formed by at least two opposing leaf springs coupling, directly or indirectly, the forearm/hand engaging portion of said crutch to the ground engaging portion, enabling said portions to move relative to one another. This spring type works nicely as a shank spring because the spring stiffness decreases with increasing spring deflection, an important shank spring characteristic.

Figure 7:
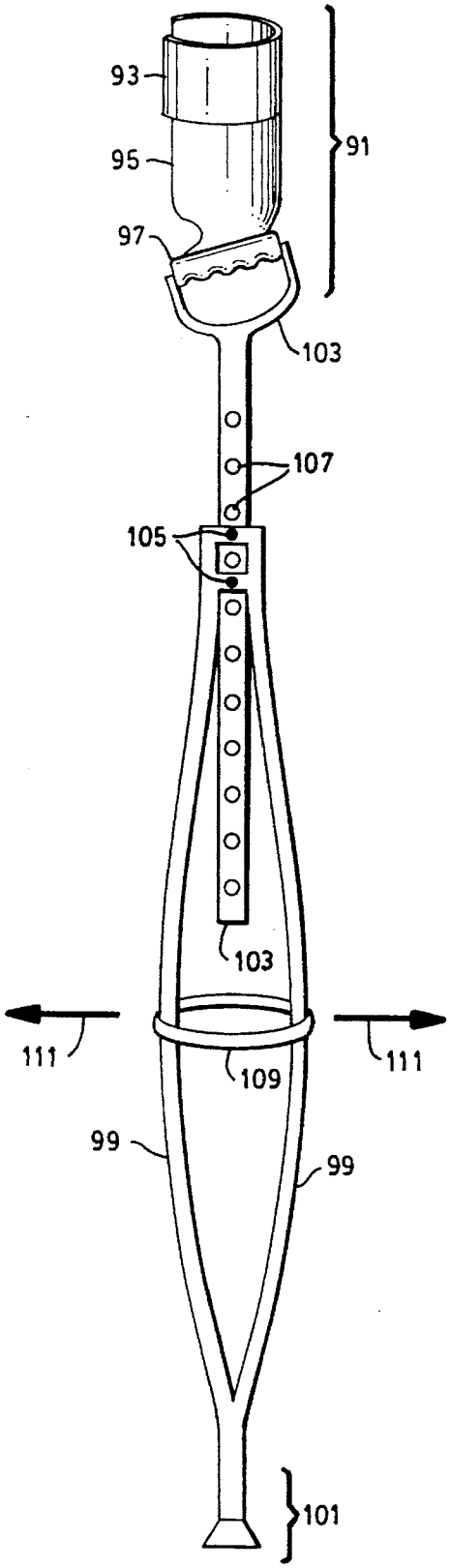
FIG. 7 shows the lateral view of a left hand crutch with two opposing leaf springs forming the shank spring and with a third spring element added to adjust shank spring stiffness.

FIG. 7 shows the lateral view of a left hand crutch with a shank spring formed by two leaf spring elements. The crutch comprises a forearm/hand engaging portion 91 and a ground engaging portion 101. The forearm/hand engaging portion 91 is formed by forearm cuff 93, forearm rest 95, and hand seat 97. Two opposing leaf springs 99 couple indirectly the forearm/hand engaging portion 91 to the ground engaging portion 101. A rigid Y-bracket 103 connects the forearm/hand engaging portion 91 to the two opposing leaf springs 99. Bolts 105 rigidly attach opposing leaf springs 99 to Y-bracket 103. The distance between hand seat 97 and ground engaging portion 101 can be adjusted for different user heights by re-bolting Y-bracket 103 to the two opposing leaf springs 99 through a different set of holes 107. Fore-and-aft spring 109 is an elastic ring, encircling leaf springs 99.

When the ground engaging portion 101 impacts with the ground during horizontal crutch locomotion, leaf springs 99 flex outward, stretching fore-and-aft spring 109 in the fore-and-aft direction depicted by axis 111. All three spring elements forming the shank spring then recoil, thrusting the crutch user upwards and forwards.

The fore-and-aft spring can be used by the crutch user to increase the shank spring stiffness. A stiffer shank spring may be desirable for rapid crutch locomotion over flat surfaces or down hills. The user should be able to take the fore-and-aft spring on and off easily. This can be accomplished in a number of ways known to the art. For example, the fore-and-aft spring can be a coil spring that clips easily onto each leaf spring, or the fore-and-aft spring can be an elastic ring that rolls onto the leaf springs as sketched in FIG. 7.

Although the preferred number of leaf springs making up the shank spring is two, additional leaf springs can be used without deviating from the soft spring design requirement discussed above for the shank spring.

Figure 8:
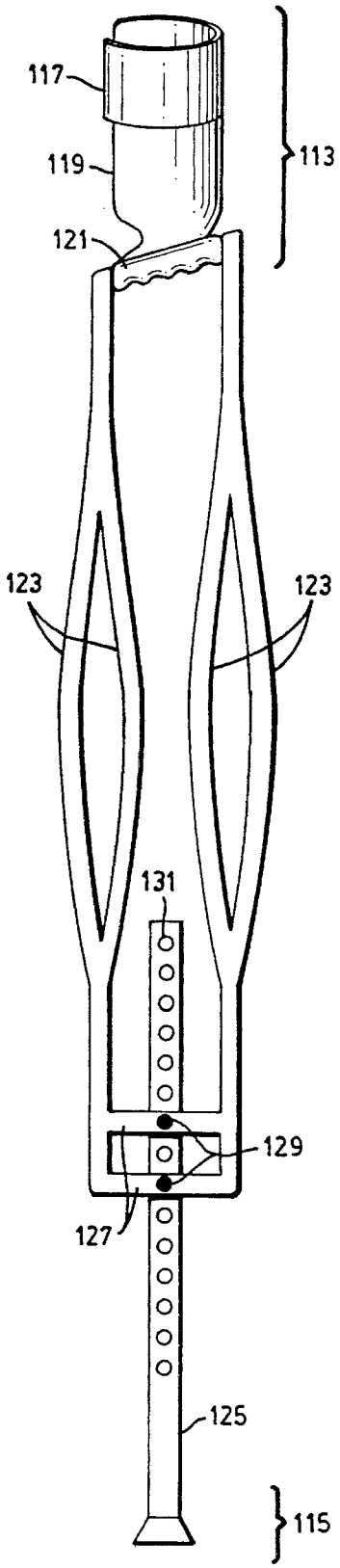
FIG. 8 shows the lateral view of a left hand crutch with four opposing leaf springs forming the shank spring.

FIG. 8 shows the lateral view of a left hand crutch with a shank spring formed by four leaf spring elements. The crutch comprises a forearm/hand engaging portion 113 and a ground engaging portion 115. The forearm/hand engaging portion 113 is formed by forearm cuff 117, forearm rest 119, and hand seat 121. Four opposing leaf springs 123 couple indirectly the forearm/hand engaging portion 113 to the ground engaging portion 115. Rigid member 125 is fastened to cross bars 127 by bolts 129 passing through holes 131. The distance between hand seat 121 and ground engaging portion 115 can be adjusted for different user heights by re-bolting rigid member 125 to cross bars 127 through a different set of holes 131.

Figure 9:
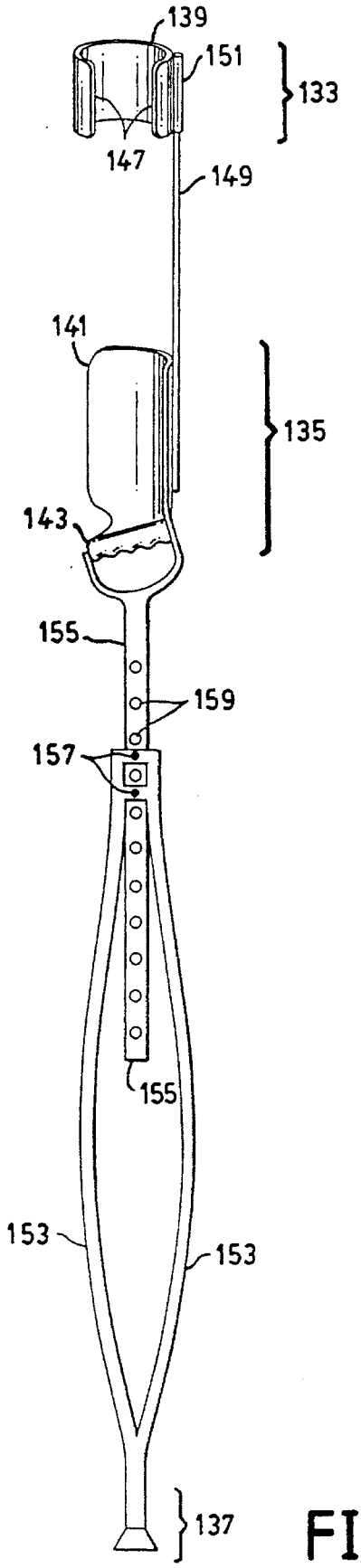
FIG. 9 shows the lateral view of a left hand crutch with an elbow spring and a shank spring.

A preferred embodiment of this invention consists of a crutch system comprising both an elbow spring and a shank spring. FIG. 9 shows the lateral view of a left hand crutch with an elbow spring formed by one leaf spring and a shank spring formed by two opposing leaf springs. The crutch has an upper arm engaging portion 133, a forearm/hand engaging portion 135, and a ground engaging portion 137. The upper arm engaging portion 133 is formed by upper arm cuff 139, and the forearm/hand engaging portion 135 is formed by forearm rest 141 and hand seat 143. The lateral side of upper arm cuff 139 has an opening 147 to allow for easy insertion of the user's upper arm into said cuff. An elbow spring formed from a single leaf spring 149 seats into housing 151 on the posterior side of upper arm cuff 139. The top portion of leaf spring 149 is not rigidly attached to upper arm cuff 139 but can piston relative to cuff 139 inside housing 151. The lower end of leaf spring 149 is clamped or fastened to the posterior side of forearm rest 141. The distance between upper arm cuff 139 and hand seat 143 can be adjusted for different arm lengths by changing the amount of leaf spring 149 and forearm rest 141 overlap and then re-clamping. Leaf spring 149 and forearm rest 141 should be attached in a manner which allows for easy adjustability as was discussed earlier. Two opposing leaf springs 153 couple indirectly the forearm/hand engaging portion 135 to the ground engaging portion 137. A rigid Y-bracket 155 connects the forearm/hand engaging portion 135 to the opposing leaf springs 153. Bolts 157 rigidly attach opposing leaf springs 153 to Y-bracket 155. The distance between hand seat 143 and ground engaging portion 137 can be adjusted for different user heights by re-bolting Y-bracket 155 to opposing leaf springs 153 through a different set of holes 159 as was also discussed earlier.

It should be understood that the invention as specifically described herein could be altered without deviating from its fundamental nature. For example, the elbow and shank springs would not have to be all one spring type as described herein. For example, the elbow spring could be formed by two coil springs and the shank spring could be formed by four opposing leaf springs. Additionally, the elbow spring could be anatomically shaped to interface with the users elbow contours properly. Still further, in order to reduce manufacturing costs, the shank and elbow springs could be made out of spring steal instead of composite material. It is therefore to be understood that within the scope of the appended claims, the invention may be practiced in ways other than as specifically described herein.

I claim:

1. A crutch comprising:

an upper arm engaging portion adapted to engage the user's upper arm;

a hand engaging portion adapted to engage the user's hand;

a ground engaging portion being secured to said hand engaging portion;

an elbow spring formed by at least one spring element coupling said upper arm engaging portion to said hand engaging portion; and wherein said elbow spring compresses and stores energy as said upper arm engaging portion is being moved toward said hand engaging portion when the user flexes his elbow.

2. The crutch of claim 1 wherein said elbow spring has a dimensionless spring stiffness less than or equal to one.

3. The crutch of claim 1 wherein said elbow spring has a dimensionless spring stiffness between ½ and ⅘.

4. The crutch of claim 1 wherein said elbow spring is formed by at least one leaf spring having a cross section with a high moment of inertia about an axis generally aligned with the fore-and-aft direction and a relatively low area moment of inertia about a horizontal axis perpendicular to the fore-and-aft direction, whereby said leaf spring(s) may flex in a vertical fore-and-aft plane and not in a vertical transverse plane.

5. The crutch of claim 4 wherein said leaf spring(s) are formed from resin-impregnated, high strength filament.

6. The crutch of claim 5 wherein at least one leaf spring formed from resin-impregnated, high strength filament has a preponderance of fiber layers having off vertical fibers in the vertical transverse plane.

7. A crutch comprising:

an upper arm engaging portion adapted to engage the user's upper arm;

a hand engaging portion adapted to engage the user's hand;

a ground engaging portion;

a shank spring formed by at least two opposing leaf springs coupling said hand engaging portion to said ground engaging portion;

an elbow spring formed by at least one spring element coupling said upper arm engaging portion to said hand engaging portion; and wherein said elbow spring compresses and stores energy as said upper arm engaging portion is being moved toward said hand engaging portion when the user flexes his elbow.

* * * * *